US008338342B2

(12) United States Patent
Kamano

(10) Patent No.: US 8,338,342 B2
(45) Date of Patent: Dec. 25, 2012

(54) LUBRICANT COMPOSITION

(75) Inventor: Hideki Kamano, Ichihara (JP)

(73) Assignee: Idemitsu Kosan Co., Ltd., Tokyo (JP)

( * ) Notice: Subject to any disclaimer, the term of this patent is extended or adjusted under 35 U.S.C. 154(b) by 190 days.

(21) Appl. No.: 12/593,935

(22) PCT Filed: Mar. 24, 2008

(86) PCT No.: PCT/JP2008/055432

§ 371 (c)(1),
(2), (4) Date: Sep. 30, 2009

(87) PCT Pub. No.: WO2008/120599

PCT Pub. Date: Oct. 9, 2008

(65) Prior Publication Data

US 2010/0137172 A1 Jun. 3, 2010

(30) Foreign Application Priority Data

Mar. 30, 2007 (JP) ..... 2007-093507

(51) Int. Cl.
*C10L 1/22* (2006.01)
*C10M 133/56* (2006.01)

(52) U.S. Cl. ..... 508/192; 508/291; 508/228

(58) Field of Classification Search ..... 508/192, 508/228, 291

See application file for complete search history.

(56) References Cited

U.S. PATENT DOCUMENTS 6,339,051 B1 * 1/2002 Carey et al. ..... 508/391
6,906,191 B2 6/2005 Koshima et al.
2002/0058593 A1 * 5/2002 Bovington et al. ..... 508/192
2006/0270567 A1 * 11/2006 Kurihara et al. ..... 508/192
2007/0179070 A1 8/2007 Kurihara et al.
2008/0020953 A1 1/2008 Kamano et al.

FOREIGN PATENT DOCUMENTS

JP 2001-226381 8/2001
WO WO 01/48055 A1 7/2001
WO 2005 090532 9/2005
WO 2006 065958 6/2006

OTHER PUBLICATIONS

U.S. Appl. No. 12/739,306, filed Apr. 22, 2010, Teshima, et al.

Yamane, K., "Biodiesel: From Deep Fryer to Fuel Tank", Tokyo-Tosho-Shuppankai, pp. 1-135 (May 2006) (with partial English translation).

U.S. Appl. No. 12/593,297, filed Sep. 28, 2009, Teshima, et al.

* cited by examiner

*Primary Examiner* — Walter D Griffin
*Assistant Examiner* — Francis C Campanell
(74) *Attorney, Agent, or Firm* — Oblon, Spivak, McClelland, Maier & Neustadt, L.L.P.

(57) ABSTRACT

A lubricating oil composition according to the present invention is used in an internal combustion engine. The internal combustion engine uses a fuel that contains at least one fat and oil selected from a group consisting of natural fat and oil, hydrotreated natural fat and oil, transesterified natural fat and oil and hydrotreated transesterified natural fat and oil. The lubricating oil composition contains a component (A) that is an alkaline earth metal-based detergent. The component (A) is contained by a content of more than 0.35 mass % and 2 mass % or less of the total amount of the composition in terms of alkaline earth metal.

14 Claims, No Drawings

LUBRICANT COMPOSITION

TECHNICAL FIELD

The present invention relates to a lubricant oil composition to be used in an internal combustion engine that uses a fuel originating from natural fat and oil.

BACKGROUND ART

These days, environmental regulations are being increasingly tightened on a global scale, among which fuel efficiency regulations and exhaust emission regulations for automobiles are especially being further tightened. Demands for tightening of the regulations are derived from environmental issues such as global warming and resource conservation due to a concern for depletion of petroleum resources.

Meanwhile, plants living on the earth absorb carbon dioxide in the air, water and sunlight to photosynthetically generate carbohydrate and oxygen. What is called, biofuel, which is manufactured from plant-based plant oil, has been gathering remarkable attentions because of its effects on reduction of carbon dioxide (a main cause of global warming) and reduction of atmospheric contaminants emitted from automobiles. In line with an idea of carbon neutral advocating that carbon dioxide generated due to combustion of plant biomass is not counted as a contributor to an increase of the global warming gas, ratio at which the biofuel is mixed in hydrocarbon fuel is expected to be increased in the future (cf. Non-Patent Document 1).

[Non-Patent Document 1] Koji YAMANE, From Biodiesel Deep Fryer to Fuel Tank, (Tokyo-Tosho-Shuppankai, May of 2006)

DISCLOSURE OF THE INVENTION

Problems to be Solved by the Invention

However, since biofuel can be easily accumulated in the engine oil due to its property and generates polar compounds when degraded and decomposed, the biofuel may adversely affect detergency of engine parts such as a piston. Such a defective phenomenon greatly depends on properties of lubricating oil used in the internal combustion engine. An object of the present invention is to provide a lubricating oil composition that is excellent in lubricity and engine-parts detergency even when biofuel or fuel mixed with the biofuel is employed in an internal combustion engine such as a diesel engine, and that imposes less adverse effects on the environment.

Means for Solving the Problems

In order to solve the above-mentioned problems, according to an aspect of the present invention, lubricating oil compositions as follows are provided:

(1) a lubricating oil composition used in an internal combustion engine, the internal combustion engine using a fuel that contains at least one fat and oil selected from a group consisting of natural fat and oil, hydrotreated natural fat and oil, transesterified natural fat and oil and hydrotreated transesterified natural fat and oil, the lubricating oil composition containing; a component (A) that is an alkaline earth metal-based detergent, in which the component (A) is contained by a content of more than 0.35 mass % and 2 mass % or less of total amount of the composition in terms of alkaline earth metal;

(2) the above-described lubrication oil composition, in which the component (A) is at least one detergent selected from a group consisting of alkaline earth metal sulfonate, alkaline earth metal phenate and alkaline earth metal salicylate;

(3) the above-described lubrication oil composition, in which base number of the component (A) is in a range of 10 to 600 mg KOH/g;

(4) the above-described lubrication oil composition, further containing a component (B) that is a boron derivative of a succinimide compound substituted by an alkyl or alkenyl group having a number average molecular weight of 200 to 5000, in which the boron derivative is contained by a content of 0.01 to 0.2 mass % in terms of boron;

(5) the above-described lubrication oil composition, in which a mass ratio (B/N) of boron (B) and nitrogen (N) contained in the component (B) is 0.5 or more; and (6) the above-described lubrication oil composition, in which a phenol-based antioxidant and/or an amine-based antioxidant are contained by 0.3 mass % or more of the total amount of the composition.

The lubricating oil composition according to the aspect of the present invention exhibits excellent detergency for engine parts such as a piston in the internal combustion engine using what is called biofuel made of natural fat and oil and the like even when the biofuel is mixed into the engine oil. Especially, the lubricating oil is excellent in high-temperature detergency when the engine reaches a high temperature.

Natural fat and oil used in the present invention is not limited to plant-derived fat and oil but may include animal-derived fat and oil.

BEST MODE FOR CARRYING OUT THE INVENTION

An embodiment of the present invention will be described in detail below.

A lubricating oil composition according to the present invention is used in an internal combustion engine. The internal combustion engine uses a fuel that contains at least one fat and oil selected from a group consisting of natural fat and oil, hydrotreated natural fat and oil, transesterified natural fat and oil and hydrotreated transesterified natural fat and oil.

Although the natural fat and oil may be a variety of animal-derived or plant-derived fat and oil that is generally available in nature, the natural fat and oil is preferably plant oil that contains ester of fatty acid and glycerin as a major ingredient, examples of which are safflower oil, soybean oil, canola oil, palm oil, palm kernel oil, cotton oil, cocoanut oil, rice bran oil, benne oil, castor oil, linseed oil, olive oil, wood oil, camellia oil, earthnut oil, kapok oil, cacao oil, haze wax, sunflower seed oil, corn oil and the like.

The hydrotreated natural fat and oil is formed by hydrogenating the above fat and oil under the presence of a suitable hydrogenating catalyst.

The hydrogenating catalyst is exemplified by a nickel-based catalyst, a platinum family (Pt, Pd, Rh, Ru) catalyst, a cobalt-based catalyst, a chrome-oxide based catalyst, a copper-based catalyst, an osmium-based catalyst, an iridium-based catalyst, a molybdenum-based catalyst and the like. A combination of two or more of the catalysts may also be preferably used as the hydrogenating catalyst.

The transesterified natural fat and oil is ester formed by transesterifying triglyceride contained in the natural fat and oil under the presence of a suitable ester-synthesis catalyst. For instance, by transesterifying lower alcohol and the fat and oil under the presence of the ester-synthesis catalyst, fatty acid ester usable as biofuel is manufactured. The lower alcohol, which is used as an esterifying agent, is exemplified by alcohol having 5 or less carbon atoms such as methanol, ethanol, propanol, butanol, pentanol and the like. In view of reactivity and cost, methanol is preferable. The lower alcohol is generally used in an amount equivalent to the fat and oil or more.

The hydrotreated transesterified natural fat and oil is formed by hydrogenating the above transesterified fat and oil under the presence of a suitable hydrogenating catalyst.

The natural fat and oil, the hydrotreated natural fat and oil, the transesterified natural fat and oil, and the hydrotreated transesterified natural fat and oil can be preferably used as mixed fuel by adding the above to fuel formed of hydrocarbon such as light oil.

The lubricating base oil used in the lubricating oil composition according to the present invention is not particularly limited but may be suitably selected from any mineral oil and synthetic oil that have been conventionally used as base oil of the lubricating oil for the internal combustion engine.

Examples of the mineral oil are mineral oil refined by processing lubricating oil fractions by at least one of solvent-deasphalting, solvent-extracting, hydrocracking, solvent-dewaxing, catalytic-dewaxing and hydrorefining (the lubricating oil fractions are obtained by vacuum-distilling atmospheric residual oil obtained by atmospherically distilling crude oil) and mineral oil manufactured by isomerizing wax and GTL WAX.

On the other hand, examples of the synthetic oil are polybutene, polyolefin ($\alpha$-olefin homopolymer or copolymer such as ethylene-$\alpha$-olefin copolymer), various esters (such as polyol ester, diacid ester and phosphoric ester), various ethers (such as polyphenylether), polyglycol, alkylbenzene, alkyl naphthalene and the like. Among the above, polyolefin and polyol ester are particularly preferable.

In the present invention, one of the above mineral oil may be singularly used or a combination of two or more thereof may be used as the base oil. In addition, one of the above synthetic oil may be singularly used or a combination of two or more thereof may be used. Further, a combination of at least one of the above mineral oil and at least one of the above synthetic oil may be used.

Although viscosity of the base oil subjects to no specific limitation and varies depending on usage of the lubricating oil composition, kinematic viscosity thereof at 100 degrees C. is generally preferably 2 to 30 $mm^2/s$, more preferably 3 to 15 $mm^2/s$, much more preferably 4 to 10 $mm^2/s$. When the kinematic viscosity at 100 degrees C. is 2 $mm^2/s$ or more, evaporation loss is small. When the kinematic viscosity at 100 degrees C. is 30 $mm^2/s$ or less, power loss due to viscosity resistance is restricted, thereby improving fuel efficiency.

As the base oil, oil whose % CA measured by a ring analysis is 3 or less and whose sulfur content is 50 ppm by mass or less can be preferably used. The % CA measured by the ring analysis means a proportion (percentage) of aromatic content calculated by the n-d-M method (a ring analysis). The sulfur content is measured based on Japanese Industrial Standard (hereinafter called, JIS) K 2541.

The base oil whose % CA is 3 or less and whose sulfur content is 50 ppm by mass or less exhibits a favorable oxidation stability. Such base oil can restrict an increase of acid number and a generation of sludge, thereby providing a lubricating oil composition that is less corrosive to metal. The sulfur content is more preferably 30 ppm by mass or less. The % CA is more preferably 1 or less, much more preferably 0.5 or less.

In addition, viscosity index of the base oil is preferably 70 or more, more preferably 100 or more, much more preferably 120 or more. In the base oil whose viscosity index is 70 or more, a viscosity change due to a temperature change is small.

The component (A) of the lubricating oil composition according to the present invention is an alkaline earth metal-based detergent. Particularly, at least one material selected from a group consisting of alkaline earth metal sulfonate, alkaline earth metal phenate and alkaline earth metal salicylate may be preferably used as the alkaline earth metal-based detergent.

An example of alkaline earth metal sulfonate is alkaline earth metal salt of alkyl aromatic sulfonic acid obtained by sulfonating an alkyl aromatic compound having a molecular weight of 300 to 1500 (preferably 400 to 700). The alkaline earth metal salt is exemplified by magnesium salt and/or calcium salt and the like, among which calcium salt is preferably used.

An example of alkaline earth metal phenate is alkaline earth metal salt of alkylphenol, alkylphenol sulfide and a Mannich reaction product of alkylphenol. The alkaline earth metal salt is exemplified by magnesium salt and/or calcium salt and the like, among which calcium salt is preferably used.

An example of alkaline earth metal salicylate is alkaline earth metal salt of alkyl salicylic acid. The alkaline earth metal salt is exemplified by magnesium salt and/or calcium salt and the like, among which calcium salt is preferably used. An alkyl group forming the alkaline earth metal-based detergent preferably has 4 to 30 carbon atoms. The alkyl group is more preferably a linear or branched alkyl group having 6 to 18 carbon atoms, in which 6 to 18 carbon atoms may be in a linear chain or in a branched chain. The alkyl group may be a primary alkyl group, a secondary alkyl group or a tertiary alkyl group.

In addition, alkaline earth metal sulfonate, alkaline earth metal phenate and alkaline earth metal salicylate may be neutral alkaline earth metal sulfonate, neutral alkaline earth metal phenate and neutral alkaline earth metal salicylate obtained by: directly reacting the above-described alkyl aromatic sulfonic acid, alkylphenol, alkylphenol sulfide, a Mannich reaction product of alkylphenol, alkyl salicylic acid or the like with alkaline earth metal base exemplified by an oxide or a hydroxide of alkaline earth metal such as magnesium and/or calcium; or converting the above-described substance into alkali metal salt such as sodium salt or potassium salt and subsequently substituting the alkali metal salt with alkaline earth metal salt. Alternatively, alkaline earth metal sulfonate, alkaline earth metal phenate and alkaline earth metal salicylate may be: basic alkaline earth metal sulfonate, basic alkaline earth metal phenate and basic alkaline earth metal salicylate obtained by heating neutral alkaline earth metal sulfonate, neutral alkaline earth metal phenate and neutral alkaline earth metal salicylate with excess alkaline earth metal salt or alkaline earth metal base under the presence of water; or overbased alkaline earth metal sulfonate, overbased alkaline earth metal phenate and overbased alkaline earth metal salicylate obtained by reacting neutral alkaline earth metal sulfonate, neutral alkaline earth metal phenate and neutral alkaline earth metal salicylate with carbonate or borate of alkaline earth metal under the presence of carbon dioxide gas.

According to the aspect of the present invention, as described above, neutral alkaline earth metal salt, basic alkaline earth metal salt, overbased (ultrabasic) alkaline earth metal salt or a mixture of the above may be used as the alkaline earth metal-based detergent (the component (A)). The total base number of the component (A) may be suitably determined. The total base number is preferably 600 mg KOH/g or less, more preferably in a range of 10 to 600 mg KOH/g, further preferably in a range of 10 to 500 mg KOH/g.

The total base number herein means the total base number measured by perchloric acid method based on the Item 7 of "Petroleum Products and Lubricating Oil—Examining Method of Neutralization Value" of JIS K2501 (1992). The alkaline earth metal-based detergent, which is diluted with light lubricant base oil and the like to be commercially available, preferably has a metal content of 1 to 20 mass %, more preferably 2 to 16 mass %.

In the present invention, the content of the alkaline earth metal-based detergent (i.e., the component (A)) is more than 0.35 mass % and 2 mass % or less of the total amount of the composition in terms of alkyl earth metal, preferably in a range of 0.4 to 1.8 mass %. When light oil whose sulfur content is more than 0.05 mass % (i.e., high-sulfur light oil) and biofuel are used together while the content of the alkaline earth metal-based detergent is 0.35 mass % or less, acid neutralization and base-number retention may not be sufficient. On the other hand, the content of the alkaline earth metal-based detergent of more than 2 mass % is not favorable because effects in proportion to the content are not obtained.

The component (B) of the lubricating oil composition according to the present invention is a boron derivative of a succinimide compound substituted by an alkyl or alkenyl group having a number average molecular weight of 200 to 5000.

Such a boron derivative of the succinimide compound can be obtained by exemplarily reacting (a) a succinic acid substituted by an alkyl or alkenyl group having the number average molecular weight of 200 to 5000 or an anhydride of the succinic acid, (b) polyalkylene polyamine and (c) a boron compound.

Materials (a), (b) and (c) and synthetic methods therefor will be described below.

As the material (a), the succinic acid substituted by the alkyl or alkenyl group or an anhydride of the succinic acid is used. The number average molecular weight (hereinafter may be abbreviated as molecular weight or Mn) of the alkyl or alkenyl group is typically 200 to 5000, preferably 500 to 2000. When the molecular weight of the alkyl or alkenyl group is less than 200, the eventually-obtained boron derivative of the succinimide compound may not be sufficiently dissolved in the base oil of the lubricating oil. When the molecular weight is more than 5000, the succinimide compound may become so highly viscous as to impair the usability.

As the alkyl or alkenyl group having such a molecular weight, a polymer or a copolymer of monoolefin and diolefin having 2 to 16 carbon atoms or a hydride of the polymer or the copolymer is typically used. Examples of monoolefin are ethylene, propylene, butene, butadiene, decene, dodecene, hexadecene and the like. Among the above-listed monoolefin, butene is particularly preferable in the present invention because of its enhanced high-temperature detergency for the engine parts and its availability. A polybutenyl group (a polymer of the butene) and a hydrogenated polybutenyl group (an alkyl group obtained by hydrogenating the polybutenyl group) are more preferable.

The alkyl or alkenyl substituted succinic acid or an anhydride of the succinic acid as the material (a) may be obtained by reacting a substance such as polybutene having the molecular weight equivalent to that of the alkyl or alkenyl group with a substance such as maleic anhydride by a conventional method.

Although polyalkylene polyamine is used for the material (b), 5 mol % or more of the total material is preferably formed from polyalkylene polyamine having a terminal ring structure. The entirety of the material (b) may be formed from polyalkylene polyamine having a terminal ring structure, or the material may be a mixture of polyalkylene polyamine having a terminal ring structure and polyalkylene polyamine having no terminal ring structure. When polyalkylene polyamine having a terminal ring structure is contained by 5 mol % or more, engine-parts detergency is further improved, which is an object of the present invention. When the content of the polyalkylene polyamine is 10 mol % or more, further 20 mol % or more, the detergency is further improved, especially detergency at a high temperature is enhanced.

In the present invention, the upper limit on the content of polyalkylene polyamine having a terminal ring structure is preferably 95 mol % or less, more preferably 90 mol % or less. When the content exceeds 95 mol %, the manufactured boronated succinimide compound may become so highly viscous as to impair manufacturing efficiency of the compound and solubility of the product in the base oil of the lubricating oil may be deteriorated. Accordingly, the content of polyalkylene polyamine having a terminal ring structure is preferably 5 to 95 mol %, more preferably 10 to 90 mol %.

The terminal ring structure of polyalkylene polyamine having a terminal ring structure is preferably represented by a formula (1) as follows.

[Chemical Formula 1]

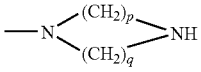

(1)

In the formula (1), p and q each represent an integer in a range of 2 to 4. Particularly, a group where both p and q are 2, i.e., piperazinyl group is preferable. A representative example of polyalkylene polyamine having a terminal ring structure is aminoalkyl piperazine having a terminal piperazinyl structure such as aminoethyl piperazine, aminopropyl piperazine, aminobutyl piperazine, amino(diethylenediamino) piperazine, amino(dipropyldiamino) piperazine and the like. Among the above, aminoethyl piperazine is particularly preferable in view of its availability.

On the other hand, polyalkylene polyamine having no terminal ring structure means polyalkylene polyamine having no ring structure or polyalkylene polyamine having a non-terminal ring structure. Representative examples of polyalkylene polyamine having no ring structure are polyethylene polyamines such as ethylenediamine, diethylenetriamine, triethylenetetramine, tetraethylenepentamine and pentaethylenehexamine, propylenediamine, dibutylenetriamine, tributylenetriamine and the like. A representative example of polyalkylene polyamine having non-terminal ring structure is di(aminoalkyl) piperazine such as di(aminoethyl) piperazine.

A mixture of polyalkylene polyamine and polyethylene polyamine such as triethylenetetramine, tetraethylenepentamine and pentaethylenehexamine among the above listed polyalkylene polyamine that may have a ring structure is particularly preferable because of its enhanced high-temperature detergency for engine-parts and its availability.

As the material (c), a boron compound is used. Examples of the boron compound are boracic acid, boric anhydride, borate ester, boric oxide and boron halogenide. Among the above, boracic acid is particularly preferable.

The component (B) according to the present invention can be obtained by reacting the materials (a), (b) and (c). Without special limitations, any known methods of reacting can be used. For instance, by reacting the materials by the following manner, the target substance can be obtained. The materials (a) and (b) are initially reacted with each other, then its reaction product is reacted with the material (c). A mixing ratio of the materials (a) to (b) in the reaction of the material (a) and (b) is preferably 0.1-to-10 to 1 (mole ratio), more preferably 0.5-to-2 to 1 (mole ratio). A reaction temperature of the materials (a) and (b) is preferably in a range of approximately 80 to 250 degrees C., more preferably in a range of approximately 100 to 200 degrees C. At the time of reacting, depending on the materials, or in order to adjust the reaction, solvents such as an organic solvent exemplified by hydrocarbon oil may be used as necessary.

Subsequently, the thus-obtained reaction product of the materials (a) and (b) is reacted with the material (c). A mixing ratio of polyalkylene polyamine to the boron compound as the reaction material (c) is typically 1 to 0.05-to-10, preferably 1 to 0.5-to-5 (mole ratio). A reaction temperature therefor is typically approximately 50 to 250 degrees C., preferably 100 to 200 degrees C. At the time of reacting, as in the reaction of the materials (a) and (b), depending on the materials or in order to adjust the reaction, solvents such as an organic solvent exemplified by hydrocarbon oil may be used as necessary.

As a product of the above reaction, a boron derivative of a succinimide compound substituted by an alkyl or alkenyl group having a number average molecular weight of 200 to 5000 (the (B) component) is obtained. In the present invention, one of the component (B) may be singularly used or a combination of two or more thereof may be used.

The content of the component (B) in the lubricating oil composition according to the present invention is 0.01 to 0.2 mass % in terms of boron (atoms) of the total amount of the composition, preferably 0.01 to 0.15 mass %, more preferably 0.01 to 0.1 mass %. Since a predetermined amount or more of boron is contained in the component (B), even when biofuel is mixed into the lubricating oil composition, pistons can be favorably cleaned in the high-temperature internal combustion engine. When the content of boron is less than 0.01 mass %, sufficient high-temperature detergency is not obtained. When the content of boron exceeds 0.2 mass %, no further improvement is made on the high-temperature detergency, which is of little practical use.

A mass ratio (B/N) of boron (B) and nitrogen (N) contained in the component (B) is preferably 0.5 or more, more preferably 0.6 or more, much more preferably 0.8 or more. When B/N is 0.5 or more, high-temperature detergency for engine parts is greatly enhanced.

Although a boronated succinimide-based compound can be obtained by initially reacting the materials (a) and (b) and subsequently reacting the reaction product thereof with the material (c), the reaction order may be changed such that the materials (a) and (c) are initially reacted and the reaction product thereof is subsequently reacted with the material (b). With this reaction order, the target boronated succinimide compound may also be likewise obtained.

The lubricating oil composition according to the present invention preferably contains a phenol-based antioxidant and/or an amine-based antioxidant as the antioxidant.

Examples of the phenol-based antioxidant are:

octadecyl-3-(3,5-di-tert-butyl-4-hydroxyphenyl)propionate;
4,4'-methylenebis(2,6-di-t-butylphenol);
4,4'-bis(2,6-di-t-butylphenol);
4,4'-bis(2-methyl-6-t-butylfhenol);
2,2'-methylenebis(4-ethyl-6-t-butylphenol);
2,2'-methylenebis(4-methyl-6-t-butylphenol);
4,4'-butylidenebis(3-methyl-6-t-butylphenol);
4,4'-isopropylidenebis(2,6-di-t-butylphenol);
2,2'-methylenebis(4-methyl-6-nonylphenol);
2,2'-isobutylidenebis(4,6-dimethylphenol);
2,2'-methylenebis(4-methyl-6-cyclohexylphenol);
2,6-di-t-butyl-4-methylphenol;
2,6-di-t-butyl-4-ethylphenol;
2,4-dimethyl-6-t-butylphenol;
2,6-di-t-amyl-p-cresol; 2,6-di-t-butyl-4-(N,N'-dimethylaminomethylphenol);
4,4'-thiobis(2-methyl-6-t-butylphenol);
4,4'-thiobis(3-methyl-6-t-butylphenol);
2,2'-thiobis(4-methyl-6-t-butylphenol);
bis(3-methyl-4-hydroxy-5-t-butylbenzyl)sulfide;
bis(3,5-di-t-butyl-4-hydroxybenzyl)sulfide;
n-octyl-3-(4-hydroxy-3,5-di-t-butylphenyl)propionate;
2,2'-thio[diethyl-bis-3-(3,5-di-t-butyl-4-hydroxyphenyl)propionate] and the like.

Among the above, bisphenyl-based antioxidant and ester group-containing phenol-based antioxidant are preferable.

Examples of the amine-based antioxidant are: an antioxidant based on monoalkyldiphenylamine such as monooctyldiphenylamine and monononyldiphenylamine; an antioxidant based on dialkyl diphenylamine such as 4,4'-dibutyldiphenylamine, 4,4'-dipentyldiphenylamine, 4,4"-dihexyldiphenylamine, 4,4'-diheptyldiphenylamine, 4,4'-dioctyldiphenylamine and 4,4'-dinonyldiphenylamine; an antioxidant based on polyalkyldiphenylamine such as tetrabutyldiphenylamine, tetrahexyldiphenylamine, tetraoctyldiphenylamine and tetranonyldiphenylamine; and an antioxidant based on naphthylamine, specifically alkyl-substituted phenyl-α-naphtylamine such as α-naphthylamine, phenyl-α-naphthylamine, butylphenyl-α-naphthylamine, pentylphenyl-α-naphthylamine, hexylphenyl-α-naphthylamine, heptylphenyl-α-naphthylamine, octylphenyl-α-naphthylamine and nonylphenyl-α-naphthylamine. Among the above, a dialkyl diphenylamine-based antioxidant and a naphthylamine-based antioxidant are preferable.

As another antioxidant, a molybdenum-amine complex-based antioxidant may be used. As the molybdenum-amine complex-based antioxidant, a hexahydric molybdenum compound, an example of which is a reaction product obtained by reacting molybdenum trioxide and/or molybdenum acid with an amine compound, may be used. The reaction product may be, for example, a compound obtained by the manufacturing method disclosed in JP-A-2003-252887. The anime compound to be reacted with the hexahydric molybdenum compound subjects to no particular limitation, and examples thereof are monoamine, diamine, polyamine and alkanolamine. Specific examples of the amine compound are: alkyl amine having an alkyl group of 1 to 30 carbon atoms (the alkyl group may contain a linear chain or a branched chain), exemplified by methylamine, ethylamine, dimethylamine, diethylamine, methylethylamine, methylpropylamine and the like; alkenyl amine having an alkenyl group of 2 to 30 carbon atoms (the alkenyl group may contain a linear chain or a branched chain), exemplified by ethenylamine, propenylamine, butenylamine, octenylamine and oleylamine; alkanol amine having an alkanol group of 1 to 30 carbon atoms (the alkanol group may contain a linear chain or a branched chain), exemplified by methanolamine, ethanolamine, methanolethanolamine and methanolpropanolamine; alkylenediamine having an alkylene group of 1 to 30 carbon atoms, exemplified by methylenediamine, ethylenediamine, propylenediamine and butylenediamine; polyamine such as diethylenetriamine, triethylenetetramine, tetraethylenepentamine and pentaethylenehexamine; a heterocyclic compound obtained by reacting monoamine, diamine and polyamine with a compound having an alkyl or alkenyl group of 8 to 20 carbon atoms or imidazoline, monoamine, diamine and polyamine being exemplified by undecyldiethylamine, undecyldiethanolamine, dodecyldipropanolamine, oleyldiethanolamine, oleylpropylenediamine and stearyltetraethylenepentamine; an alkylene-oxide adduct of the compounds; and a mixture thereof. In addition, sulfur-containing molybdenum complexes of succinimide as disclosed in JP-B-03-22438 and JP-A-2004-2866 may be used.

A content of the antioxidant is preferably 0.3 mass % or more of the total amount of the composition, more preferably 0.5 mass % or more. On the other hand, when the content exceeds 2 mass %, the antioxidant may not be dissolved in the base oil of the lubricating oil. Accordingly, the contents of the antioxidant is preferably in a range from 0.3 to 2 mass % of the total amount of the composition.

The lubricating oil composition according to the present invention may be added as necessary with other additives such as a viscosity index improver, a pour point depressant, antiwear agent, an ashless-type friction modifier, a rust inhibitor, a metal deactivator, a surfactant and antifoaming agent as long as effects of the present invention are not hampered.

Examples of the viscosity index improver are polymethacrylate, dispersed polymethacrylate, an olefin-based copolymer (such as an ethylene-propylene copolymer), a dispersed olefin-based copolymer, a styrene-based copolymer (such as a styrene-diene copolymer and a styrene-isoprene copolymer) and the like. In view of blending effects, a content of the viscosity index improver is 0.5 to 15 mass % of the total amount of the composition, preferably 1 to 10 mass %.

An example of the pour point depressant is polymethacrylate having a weight-average molecular weight of 5000 to 50000.

Examples of the antiwear agent are: sulfur-containing compounds such as zinc dithiophosphate, zinc dithiocarbamate, zinc phosphate, disulfides, sulfurized olefins, sulfurized fats and oils, sulfurized esters, thiocarbonates, thiocarbamates (such as Mo-DTC) and the like; phosphorus-containing compounds such as phosphite esters, phosphate esters, phosphonate esters and amino salts or metal salts thereof; and a sulfur and phosphorus-containing antiwear agent such as thiophosphite esters, thiophosphate esters (such as Mo-DTP), thiophosphonate esters and amino salts or metal salts thereof.

As the ashless-type friction modifier, any compounds generally used as the ashless-type friction modifier for lubricating oil may be used, examples of which are fatty acid, aliphatic alcohol, aliphatic ether, aliphatic ester, aliphatic amine and aliphatic amide that have at least one alkyl or alkenyl group of 6 to 30 carbon atoms in the molecule.

Examples of the rust inhibitor are petroleum sulfonate, alkylbenzene sulfonate, dinonylnaphthalene sulfonate, alkenyl succinic ester, multivalent alcohol ester and the like. In view of blending effects, a content of the rust inhibitor is typically 0.01 to 1 mass % of the total amount of the composition, preferably 0.05 to 0.5 mass %.

Examples of the metal deactivator (copper corrosion inhibitor) are benzotriazole-based compounds, tolyltriazole-based compounds, thiadiazole-based compounds and imidazole-based compounds. Among the above, the benzotriazole-based compounds are preferable. By adding the metal deactivator, the engine parts can be prevented from being metallically corroded and degraded due to oxidation. In view of blending effects, a content of the metal deactivator is preferably 0.01 to 0.1 mass % of the total amount of the composition, more preferably 0.03 to 0.05 mass %.

Examples of the surfactant are nonionic surfactants based on polyalkylene glycol such as polyoxyethylenealkylether, polyoxyethylenealkylphenylether and polyoxyethylenealkylnaphthylether.

Examples of the antifoaming agent are silicone oil, fluorosilicone oil, fluoroalkylether and the like. In view of a balance between antifoaming effects and economics, a content of the antifoaming agent is preferably approximately 0.005 to 0.1 mass % of the total amount of the compound.

Sulfur content of the lubricating oil composition according to the present invention is preferably 0.5 mass % or less of the total amount of the composition, more preferably 0.3 mass % or less, much more preferably 0.2 mass % or less. When the sulfur content is 0.5 mass % or less, deterioration of the catalyst performance for purifying exhaust gas can be effectively prevented.

Phosphorus content of the lubricating oil composition according to the present invention is preferably 0.12 mass % or less of the total amount of the composition, more preferably 0.1 mass % or less. When the phosphorus content is 0.12 mass % or less, deterioration of the catalyst performance for purifying exhaust gas can be effectively prevented.

Since the lubricating oil composition according to the present invention contains the predetermined amounts of the component (A), even when used in the internal combustion engine that consumes biofuel, the lubricating oil composition exhibits excellent detergency for the engine parts such as pistons. Particularly, by adding the component (B) by a predetermined amount in addition to the component (A), the detergency at a high temperature can be further enhanced.

EXAMPLES

Next, the present invention will be further described in detail based on Examples, which by no means limit the present invention.

Examples 1 to 6 and Comparative 1

Lubricating oil compositions containing components shown in Table 1 was prepared, which were then subjected to such a hot tube test as follows. The components used for preparing the lubricating oil compositions are as follows.

(1) Base Oil of Lubricating Oil: hydrorefined base oil; kinematic viscosity at 40 degrees C. of 21 $mm^2/s$; kinematic viscosity at 100 degrees C. of 4.5 $mm^2/s$; viscosity index of 127; % CA of 0.0; sulfur content of less than 20 mass ppm; and NOACK evaporation of 13.3 mass %.

(2) Metal-Based Detergent A (Component A): overbased calcium salicylate; base number of 225 mg KOH/g (perchloric acid method); calcium content of 7.8 mass %; and sulfur content of 0.3 mass %.

(3) Metal-Based Detergent B (Component A): overbased calcium phenate; base number of 255 mg KOH/g (perchloric acid method); calcium content of 9.3 mass %; and sulfur content of 3.0 mass %.

(4) Metal-Based Detergent C (Component A): calcium sulfonate; base number of 17 mg KOH/g (perchloric acid method); calcium content of 2.4 mass %; and sulfur content of 2.8 mass %.

(5) Polybutenyl Succinic Monoimide A (Component B): number average molecular weight of the polybutenyl group being 1000; nitrogen content of 1.76 mass %; boron content of 2.0 mass %; and B/N of 1.1.

The above polybutenyl succinic monoimide A was manufactured by the following method. 550 g of polybutene (Mn: 980), 1.5 g (0.005 mol) of cetyl bromide and 59 g (0.6 mol) of maleic acid anhydride were put into an autoclave of 1 litter, which were then subjected to nitrogen substitution and reacted with one another at 240 degrees C. for five hours. After the temperature was lowered to 215 degrees C., unreacted maleic acid anhydride and unreacted cetyl bromide were distilled away therefrom under a low pressure. After the temperature was further lowered to 140 degrees C., filtration was conducted. An yield of obtained polybutenyl succicic anhydride was 550 g and its saponification number was 86 mg KOH/g. 500 g of obtained polybutenyl succicic anhydride, 17.4 g (0.135 mol) of aminoethyl piperazine (AEP), 10.3 g (0.10 mol) of diethylene triamine (DETA), 14.6 g (0.10 mol) of triethylene tetramine (TETA) and 250 g of mineral oil were put into a separable flask of 1 litter and reacted with one another in nitrogen gas stream at 150 degrees C. for two hours. After the temperature was raised to 200 degrees C., unreacted AEP, DETA and TETA and generated water were distilled away therefrom under a low pressure. An yield of obtained polybutenyl succicic imide was 750 g and its base number was 51 mg KOH/g (by a perchloric acid method). 150 g of obtained polybutenyl succicic imide and 20 g of boric acid were put into a separable flask of 500 milliliter and reacted with each other in nitrogen gas stream at 150 degrees C. for four hours. After generated water was distilled away therefrom under a low pressure at 150 degrees C., the temperature was lowered to 140 degrees C. and filtration was conducted. An yield of generated polybutenyl succinic monoimide A was 165 g and its boron content was 2.0 mass %. Polyalkylene polyamine having a terminal ring structure was approximately 40 mol % of the total polyalkylene polyamine.

(6) Polybutenyl Succinic Bisimide B: number average molecular weight of the polybutenyl group being 2000; nitrogen content of 0.99 mass %; and B/N of 0.

(7) Polybutenyl Succinic Monoimide C (Component B): number average molecular weight of the polybutenyl group being 1000; nitrogen content of 1.95 mass %; boron content of 0.67 mass %; and B/N of 0.3.

Polybutenyl succicic monoimide C was reacted and manufactured by the same method as polybutenyl succicic monoimide A, except that 18 g (0.17 mol) of diethylene triamine (DETA) and 25 g (0.17 mol) of triethylene tetramine (TETA) were used in place of 17.4 g (0.135 mol) of aminoethyl piperazine (AEP), 10.3 g (0.10 mol) of diethylene triamine (DETA) and 14.6 g (0.10 mol) of triethylene tetramine (TETA) and that boric acid was added by 13 g. An yield of generated polybutenyl succinic monoimide C was 161 g. No polyalkylene polyamine having a terminal ring structure was contained therein.

(8) Phenol-Based Antioxidant: octadecyl-3-(3,5-di-tert-butyl-4-hydroxyphenyl)propionate.

(9) Amine-Based Antioxidant: dialkyl diphenylamine; nitrogen content of 4.62 mass %.

(10) Viscosity Index Improver: olefin copolymer; mass average molecular weight of 90000; and resin content of 11.1 mass %.

(11) Pour Point Depressant: polymethacrylate; and mass average molecular weight of 6000.

(12) Zinc Dialkyl Dithio Phosphate: Zn content of 9.0 mass %; phosphorus content of 8.2 mass %; sulfur content of 17.1 mass %; and the alkyl group being a mixture of a secondary butyl group and a secondary hexyl group.

(13) Copper Corrosion Inhibitor: 1-[N,N-bis(2-ethylhexyl) aminomethyl]methyl benzotriazole.

(14) Other Additives: a rust inhibitor, a surfactant and an antifoaming agent.

Measurement of properties of the lubricating oil compositions and the hot tube test were conducted in the following manner.

(Calcium Content)

Measurement was conducted based on JPI-5S-38-92.

(Boron Content)

Measurement was conducted based on JPI-5S-38-92.

(Nitrogen Content)

Measurement was conducted based on JIS K2609.

(Phosphorus Content)

Measurement was conducted based on JPI-5S-38-92.

(Sulfur Content)

Measurement was conducted based on JIS K2541.

(Zinc Content)

Measurement was conducted based on JPI-5S-38-92.

(Sulfated Ash Content)

Measurement was conducted based on JIS K2272.

(Hot Tube Test)

As the lubricating oil composition to be tested, mixed oil in which biofuel (fuel obtained by transesterifying canola oil with methyl alcohol) was mixed by 5 mass % of each of the lubricating oil compositions (new oil) was used, assuming a mixing ratio of the fuel and the lubricating oil in an internal combustion engine. The measurement was conducted with the test temperature being set at 300 degrees C. and other conditions being based on JPI-5S-55-99. For reference, the same test was also conducted using only new oil. In addition, since the hot tube test may be affected by the amount of the viscosity index improver, the mixing amount of the viscosity index improver was made constant among Examples and Comparatives. The smaller an amount of fouling on the glass tube after the test was, the more favorable the detergency is.

The properties of the lubricating oil compositions and the results of the hot tube test are shown in Table 1.

TABLE 1

| | | Example 1 | Example 2 | Example 3 | Example 4 | Example 5 | Example 6 | Comparative 1 |
|---|---|---|---|---|---|---|---|---|
| Contained Component (mass %) | Base Oil of Lublicating Oil A | 79.45 | 79.45 | 78.95 | 78.25 | 79.15 | 78.15 | 82.92 |
| | Metal-Based Detergent A | 5.30 | 5.30 | 5.30 | 5.00 | 3.80 | 3.80 | 2.82 |
| | Metal-Based Detergent B | — | — | — | — | 1.30 | 1.30 | — |
| | Metal-Based Detergent C | — | — | — | 1.00 | — | — | — |
| | Polybutenyl Succinic Monoimide A (B/N = 1.1) | 1.00 | 1.00 | 1.00 | 1.00 | 1.00 | — | — |
| | Polybutenyl Succinic Bisimide B (B/N = 0) | 5.00 | 5.00 | 5.00 | 5.00 | 5.00 | 4.00 | 5.00 |
| | Polybutenyl Succinic Monoimide C (B/N = 0.3) | — | — | — | — | — | 3.00 | — |
| | Phenol-Based Antioxidant | 0.50 | — | 0.50 | 0.50 | 0.50 | 0.50 | 0.50 |
| | Amine-Based Antioxidant | — | 0.50 | 0.50 | 0.50 | 0.50 | 0.50 | 0.50 |
| | Viscosity Index Improver | 6.50 | 6.50 | 6.50 | 6.50 | 6.50 | 6.50 | 6.50 |
| | Pour Point Depressant | 0.30 | 0.30 | 0.30 | 0.30 | 0.30 | 0.30 | 0.30 |
| | Zinc Dialkyl Dithio Phosphate | 1.40 | 1.40 | 1.40 | 1.40 | 1.40 | 1.40 | 1.40 |

TABLE 1-continued

| | | Example 1 | Example 2 | Example 3 | Example 4 | Example 5 | Example 6 | Comparative 1 |
|---|---|---|---|---|---|---|---|---|
| | Copper Corrosion Inhibitor | 0.05 | 0.05 | 0.05 | 0.05 | 0.05 | 0.05 | 0.05 |
| | Others | 0.50 | 0.50 | 0.50 | 0.50 | 0.50 | 0.50 | 0.50 |
| | Total | 100.00 | 100.00 | 100.00 | 100.00 | 100.00 | 100.00 | 100.00 |
| Composition Properties (mass %) | Calcium Content | 0.41 | 0.41 | 0.41 | 0.41 | 0.42 | 0.42 | 0.22 |
| | Boron Content | 0.02 | 0.02 | 0.02 | 0.02 | 0.02 | 0.01 | 0.00 |
| | Nitrogen Content | 0.07 | 0.09 | 0.09 | 0.09 | 0.09 | 0.11 | 0.07 |
| | Sulfur Content | 0.3 | 0.3 | 0.3 | 0.3 | 0.3 | 0.3 | 0.2 |
| | Phosphorus Content | 0.11 | 0.11 | 0.11 | 0.11 | 0.11 | 0.11 | 0.11 |
| | Zinc Content | 0.13 | 0.13 | 0.13 | 0.13 | 0.13 | 0.13 | 0.13 |
| | Sulfated Ash Content | 1.64 | 1.64 | 1.64 | 1.65 | 1.66 | 1.65 | 0.99 |
| Hot Tube Test (Fouling Amount mg) | 95 mass % New oil plus 5 mass % Biofuel | 0.6 | 0.5 | 0.2 | 0.2 | 0.3 | 0.3 | 62.3 |
| | New oil (Reference) | 0.1 | 0.1 | 0.1 | 0.2 | 0.2 | 0.2 | 2.2 |

Examples 7 and 8, and Comparative 2

Lubricating oil compositions containing components shown in Table 2 was prepared, which were then subjected to such a hot tube test as follows. The components used for preparing the lubricating oil compositions are as follows.

(1) Base Oil of Lubricating Oil B: hydrorefined base oil; kinematic viscosity at 40 degrees C. of 90.51 $mm^2/s$; kinematic viscosity at 100 degrees C. of 10.89 $mm^2/s$; viscosity index of 107; % CA of 0.0; sulfur content of less than 20 mass ppm; and NOACK evaporation of 2.9 mass %.

(2) Pour Point Depressant: polymethacrylate; and mass average molecular weight of 6000.

(3) Metal-Based Detergent A: overbased calcium salicylate; base number of 225 mg KOH/g (perchloric acid method); calcium content of 7.8 mass %; and sulfur content of 0.3 mass %.

(4) Polybutenyl Succinic Monoimide A: number average molecular weight of the polybutenyl group being 1000; nitrogen content of 1.76 mass %; and boron content of 2.0 mass %.

(5) Phenol-Based Antioxidant: 4,4'-methylenebis (2,6-di-tert-butylphenol).

(6) Amine-Based Antioxidant: dialkyl diphenylamine; nitrogen content of 4.62 mass %.

(7) Zinc Dialkyl Dithio Phosphate: Zn content of 9.0 mass %; phosphorus content of 8.2 mass %; sulfur content of 17.1 mass %; and the alkyl group being a mixture of a secondary butyl group and a secondary hexyl group.

Measurement of properties of the lubricating oil compositions and the hot tube test were conducted in the following manner.

(Calcium Content)

Measurement was conducted based on JPI-5S-38-92.

(Boron Content)

Measurement was conducted based on JPI-5S-38-92.

(Sulfur Content)

Measurement was conducted based on JIS K2541.

(Phosphorus Content)

Measurement was conducted based on JPI-5S-38-92.

(Sulfated Ash Content)

Measurement was conducted based on JIS K2272.

(Hot Tube Test)

As the lubricating oil composition to be tested, mixed oil in which biofuel (fuel obtained by transesterifying canola oil with methyl alcohol) was mixed by 15 mass % of each of the lubricating oil compositions (new oil) was used, assuming a mixing ratio of the fuel and the lubricating oil in an internal combustion engine. The measurement was conducted with the test temperature being set at 320 degrees C. and other conditions being based on JPI-5S-55-99. For reference, the same test was also conducted using only new oil. In addition, neither viscosity index improver nor copper corrosion inhibitor was added in Examples 7 and 8 and Comparative 2. The smaller an amount of fouling on the glass tube after the test was, the more favorable the detergency is.

The properties of the lubricating oil compositions and the results of the hot tube test are shown in Table 2.

TABLE 2

| | | Example 7 | Example 8 | Comparative 2 |
|---|---|---|---|---|
| Contained Components (mass %) | Base Oil of Lubricating Oil B | 74.30 | 72.30 | 75.30 |
| | Viscosity Index Improver | 0.00 | 0.00 | 0.00 |
| | Pour Point Depressant | 0.30 | 0.30 | 0.30 |
| | Metal-Based Detergent A | 23.00 | 23.00 | 23.00 |
| | Polybutenyl Succinic Monoimide A | 1.00 | 3.00 | — |
| | Phenol-Based Antioxidant | 0.50 | 0.50 | 0.50 |
| | Amine-Based Antioxidant | 0.50 | 0.50 | 0.50 |
| | Zinc Dialkyl Dithio Phosphate | 0.30 | 0.30 | 0.30 |
| | Copper Corrosion Inhibitor | 0 | 0 | 0 |
| | Others | 0.10 | 0.10 | 0.10 |
| | Total | 100.00 | 100.00 | 100.00 |
| Composition Properties (mass %) | Calcium Content | 1.79 | 1.79 | 1.79 |
| | Boron Content | 0.02 | 0.06 | 0.00 |
| | Sulfur Content | 0.12 | 0.12 | 0.12 |
| | Phosphorus Content | 0.02 | 0.02 | 0.02 |
| | Sulfated Ash Content | 5.96 | 5.99 | 5.95 |

TABLE 2-continued

| | | Example 7 | Example 8 | Comparative 2 |
|---|---|---|---|---|
| Hot Tube Test (Fouling Amount mg) | 85 mass % New oil plus 15 mass % Biofuel | 8.3 | 2.1 | 163.8 |
| | New oil (Reference) | 0.7 | 1.1 | 1.8 |

[Evaluation Result]

As is understood from the results of the hot tube test shown in Table 1, Examples 1 to 6, where the lubricating oil composition according to the present invention was used, produced almost as small an amount of fouling as the corresponding new oil (i.e., a lubricating oil composition to which no biofuel was added), irrespective of the addition of the biofuel. On the other hand, Comparative 1, where the component (A) according to the present invention was added by a small amount, produced a much larger amount of fouling than the corresponding new oil due to the addition of the biofuel although the corresponding new oil itself produced a slightly-larger amount of fouling. Accordingly, it is hardly possible to expect Comparative 1 to have detergency as engine oil.

In addition, as is understood from the results of the hot tube test shown in Table 2, Examples 7 and 8, where the lubricating oil composition according to the present invention was used, produced an amount of fouling that is increased only by a slight amount as compared with the corresponding new oil, irrespective of the addition of the biofuel by a mixing ratio of 15 mass %. On the other hand, Comparative 2, where the component (A) according to the present invention was not added, produced a significantly large amount of fouling. Accordingly, it is hardly possible to expect Comparative 2 to have detergency as engine oil.

The invention claimed is:

1. A lubricating oil composition for an internal combustion engine, the internal combustion engine using a fuel that comprises at least one fat and oil selected from a group consisting of natural fat and oil, hydrotreated natural fat and oil, transesterified natural fat and oil and hydrotreated transesterified natural fat and oil, the lubricating oil composition comprising:

a component (A) that is an alkaline earth metal-based detergent and a component (B) that is a boron derivative of a succinimide compound substituted by an alkyl or alkenyl group having a number average molecular weight of 200 to 5000, wherein a mass ratio (B/N) of boron (B) and nitrogen (N) in the component (B) is 0.5 or more, wherein the lubricant oil comprises the component (A) in an amount which contributes from 0.4 mass % to 2 mass % of alkaline earth metal based on the total amount of the composition, and the component (B) in an amount which contributes from 0.01 to 0.2 mass % of boron based on the total amount of the composition, and wherein the lubricant oil comprises at least one of a phenol-based antioxidant and an amine-based antioxidant in an amount of 0.3 mass % or more of the total amount of the composition.

2. The lubricant oil composition according to claim 1, wherein the component (A) is at least one detergent selected from a group consisting of alkaline earth metal sulfonate, alkaline earth metal phenate and alkaline earth metal salicylate.

3. The lubricant oil composition according to claim 1, wherein a base number of the component (A) is in a range of 10 to 600 mg KOH/g.

4. The lubricant oil composition according to claim 1, wherein the lubricant oil comprises at least one of a phenol-based antioxidant and an amine-based antioxidant in an amount of 0.5 mass % or more of the total amount of the composition.

5. A method for operating an internal combustion engine, comprising supplying the internal combustion engine with a fuel that comprises at least one fat and oil selected from the group consisting of natural fat and oil, hydrotreated natural fat and oil, transesterified natural fat and oil and hydrotreated transesterified natural fat and oil, wherein the internal combustion engine comprises the lubricating oil composition according to claim 1.

6. The lubricating oil composition according to claim 1, wherein the alkaline earth metal is calcium.

7. The lubricating oil composition according to claim 3, wherein the base number is in a range of 10 to 500 mg KOH/g.

8. The lubricating oil composition according to claim 1, wherein component (A) contributes 0.4 to 1.8 mass % of alkaline earth metal based on the total amount of the composition.

9. The lubricating oil composition according to claim 1, wherein B/N is 0.6 or more.

10. The lubricating oil composition according to claim 1, wherein B/N is 0.8 or more.

11. The lubricating oil composition according to claim 4, wherein the lubricant oil comprises a phenol-based antioxidant.

12. The lubricating oil composition according to claim 11, wherein the phenol-based antioxidant is a bisphenyl-based antioxidant or an ester group-containing phenol-based antioxidant.

13. The lubricating oil composition according to claim 4, wherein the lubricant oil comprises an amine-based antioxidant.

14. The lubricating oil composition according to claim 13, wherein the amine-based antioxidant is a dialkyl diphenylamine-based antioxidant or a naphthylamine-based antioxidant.

* * * * *